US008037807B2

(12) United States Patent
Callaghan et al.

(10) Patent No.: US 8,037,807 B2
(45) Date of Patent: Oct. 18, 2011

(54) CONTROLLED MOTION IN A HYDRAULICALLY ACTUATED SYSTEM

(75) Inventors: Merritt P. Callaghan, La Hulpe (GB); Justin P. Pahl, Peoria, IL (US); Brian W. Tracy, New Lenox, IL (US); Joel C. Weber, Naperville, IL (US); Wayne E. Harshberger, Oswego, IL (US); Rajeev V. Kumar, Peoria, IL (US); Steven C. Budde, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 477 days.

(21) Appl. No.: 12/121,899

(22) Filed: May 16, 2008

(65) Prior Publication Data

US 2008/0295679 A1 Dec. 4, 2008

Related U.S. Application Data

(60) Provisional application No. 60/930,734, filed on May 18, 2007.

(51) Int. Cl.
*F15B 13/16* (2006.01)
*E02F 3/43* (2006.01)

(52) U.S. Cl. ..... 91/361; 91/459

(58) Field of Classification Search ..... 91/1, 361, 91/363 A, 459
See application file for complete search history.

(56) References Cited

U.S. PATENT DOCUMENTS

| | | | | |
|---|---|---|---|---|
| 4,844,685 | A * | 7/1989 | Sagaser | 91/363 R |
| 5,784,944 | A * | 7/1998 | Tozawa et al. | 91/361 |
| 5,993,138 | A * | 11/1999 | Anderson et al. | 414/706 |
| 6,099,236 | A | 8/2000 | Wiechman | |
| 6,951,067 | B1 * | 10/2005 | Dietz et al. | 701/50 |

FOREIGN PATENT DOCUMENTS

| | | |
|---|---|---|
| EP | 0258819 | 3/1988 |
| JP | 07109749 | 4/1995 |
| JP | 11093199 | 4/1999 |
| WO | 9615326 | 5/1996 |

* cited by examiner

*Primary Examiner* — Thomas E Lazo
(74) *Attorney, Agent, or Firm* — Richard K. Chang

(57) ABSTRACT

A machine configured to prevent unintentional motion in a linkage pivotally connected to a frame may include a first hydraulic actuator connected to the linkage and a second hydraulic actuator connected to the linkage. The machine may include a sensor and an electronic control module in communication with the sensor. The electronic control module may be configured to close a valve of the first hydraulic cylinder and/or cancel an actuation command to one of the first hydraulic actuator and the second hydraulic actuator in response to the electronic control module determining unintentional motion of the linkage has occurred based on the sensor.

20 Claims, 4 Drawing Sheets

CONTROLLED MOTION IN A HYDRAULICALLY ACTUATED SYSTEM

TECHNICAL FIELD

This invention relates generally to a system and method for improved motion control in a hydraulically actuated system of a machine.

BACKGROUND

Hydraulically actuated systems, such as hydraulically actuated linkages, may include a plurality of hydraulic actuators that each moves a linkage in a desired range of motion. Thus, the plurality of hydraulic actuators may be used to provide controlled movement of the linkage. However, in some circumstances, when a first hydraulic actuator is actuated, the first hydraulic actuator may induce unintentional movement in the linkage. Further, the first hydraulic actuator may cause a second hydraulic actuator to store energy that may release and also cause unintentional movement in the linkage.

SUMMARY OF THE INVENTION

In one aspect, a machine includes a frame, a linkage pivotally connected to the frame, a first hydraulic actuator connected to the linkage, and a second hydraulic actuator connected to the linkage. Additionally, the machine includes a sensor and an electronic control module in communication with the sensor. The electronic control module may be configured to cancel an actuation command to one of the first hydraulic actuator and the second hydraulic actuator in response to the electronic control module determining unintentional motion of the linkage has occurred based on the sensor.

In another aspect, the machine may include a linkage having a rack stop and one or more of a coupler and work tool. Additionally, the first and second hydraulic actuators may be a lift hydraulic actuator and a tilt hydraulic actuator connected to the linkage and disposed to actuate the one or more of a coupler and a work tool relative to the rack stop. The electronic control module may be configured to determine when the coupler or work tool is disposed near or in contact with the rack stop from the sensor, so that the electronic control module may to cancel an actuation command to one of the first hydraulic actuator and the second hydraulic actuator in response to determining the coupler or work tool is disposed near or in contact with the rack stop.

In another aspect, the lift hydraulic actuator may include a valve. Additionally, the electronic control module may be configured to close the valve in response to the electronic control module determining unintentional motion of the linkage has occurred based on the sensor.

DETAILED DESCRIPTION

Figure 1:
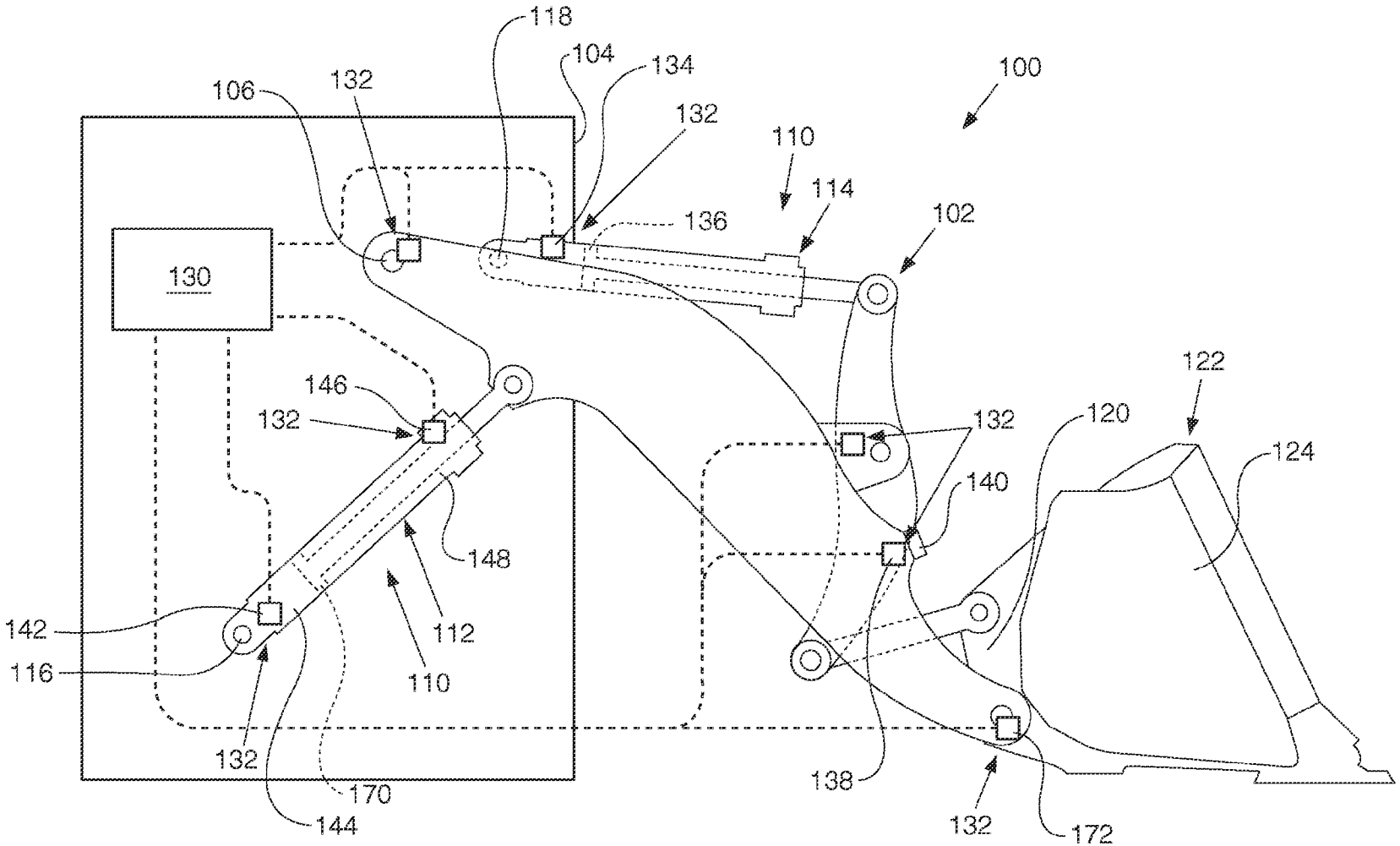
FIG. 1 is a plan view of a hydraulically actuated linkage of a machine in a first position.

Referring to FIG. 1, a plan view illustrates a machine 100 having a hydraulically actuated linkage 102 that may be pivotally attached to a frame 104 at a pivot 106. The machine 100 may be wheel loader, tracked loader, backhoe loader, integrated tool carrier, excavator, material handler, feller buncher, knuckleboom loader, tree harvester, skidder, pipe layer, or any other machine known in the art having a hydraulically actuated linkage.

For purposes of demonstration, the linkage 102 may be a Z-bar linkage, a four bar linkage, a six bar linkage, an eight bar linkage, or any other linkage known in the art and may be disposed in a first position by a plurality of hydraulic actuators 110. As shown, the plurality of hydraulic actuators 110 may include a first hydraulic actuator 112 and a second hydraulic actuator 114.

The first hydraulic actuator 112 may be pivotally attached to the frame 104 at a pivot 116. The first hydraulic actuator 112 may be a "lift actuator" for pivoting the linkage 102 relative to the frame 104. As shown in this configuration, when the first hydraulic actuator 112 is extended, the linkage 102 may be raised and pivoted about pivot 106. Conversely, when the first hydraulic actuator 112 is retracted, the linkage 102 may be lowered. Of course, in other linkage configurations and/or hydraulic actuator configurations, the opposite motions may be obtained in response to actuation of the first hydraulic actuator 112.

The second hydraulic actuator 114 may also be pivotally attached to the frame 104 at a pivot 118. The second hydraulic actuator 114 may be a "tilt actuator" for tilting a coupler 120 of the linkage 102 upward toward the rack stop 140 or downward away from the rack stop 140.

As shown, a work tool 122, such as a bucket 124, may be attached to the coupler 120. In other configuration, the work tool 122 may be a grapple, claw, chipper, drill, fork, broom, blade, hammer, or any other work tool known in the art. Additionally in some configurations, the coupler 120 and the work tool 122 may be integrated into a single unit (not shown).

In this configuration, when the second hydraulic actuator 114 is extended, the coupler 120 may be tilted upward such that the bucket 124 may be positioned to retain material (not shown) in the bucket 124. When the second hydraulic actuator 114 is retracted, the coupler 120 may be tilted downward such that material may be dumped out of the bucket 124. In other configurations of the linkage 102 and the plurality of hydraulic actuators 110, the first hydraulic actuator 112 and the second hydraulic actuator 114 may operate in reverse, or provide other ranges and directions of motion.

As shown, the machine 100 may also include an electronic control module (ECM) 130 for controlling the electro-hydraulic systems, which include the plurality of hydraulic actuators 110, of the machine 100. The ECM 130 may be in communication with one or more sensors 132 for detecting one or more conditions of the linkage 102 and/or the plurality of hydraulic actuators 110.

The one or more sensors 132 may be pressure sensors, position sensors, rotary sensors, proximity sensors, or any other sensor known in the art for sensing various conditions of the linkage 102 and/or the plurality of hydraulic actuators 110. The one or more sensors 132 may be placed in any of the locations shown or may be positioned at other locations of the linkage 102 or machine 100.

For example, a sensor 133 may be a rotary sensor for detecting the rotational angle or tilt angle velocity of the linkage 102 about pivot 135, which may be used to determine the rotation of the coupling 120 relative to the rack stop 140.

Likewise, a sensor 134 may be positioned relative to the second hydraulic actuator 114. The sensor 134 may be position sensor for determining the position of the piston 136 of the second hydraulic actuator 114. Alternatively, the sensor 134 may be a pressure sensor for detecting the pressure of fluid within the second hydraulic actuator 114. Additionally, the sensor 134 may be a motion sensor for detecting motion of the second hydraulic actuator 114.

In another example, a sensor 138 may be a proximity sensor disposed to determine when the coupler 120 or work tool 122 has been tilted near a rack stop 140. In some configurations, the sensor 138 may be an RFID scanner that may serve the additional purpose of identifying an attached work tool 122 by scanning an RFID tag (not shown) attached to the work tool 122.

Alternatively, a sensor 142 may be disposed to sense the fluid pressure within the head portion 144 and a sensor 146 may be disposed to sense pressure within the rod portion of the 148 of the first hydraulic actuator 112.

Figure 2:
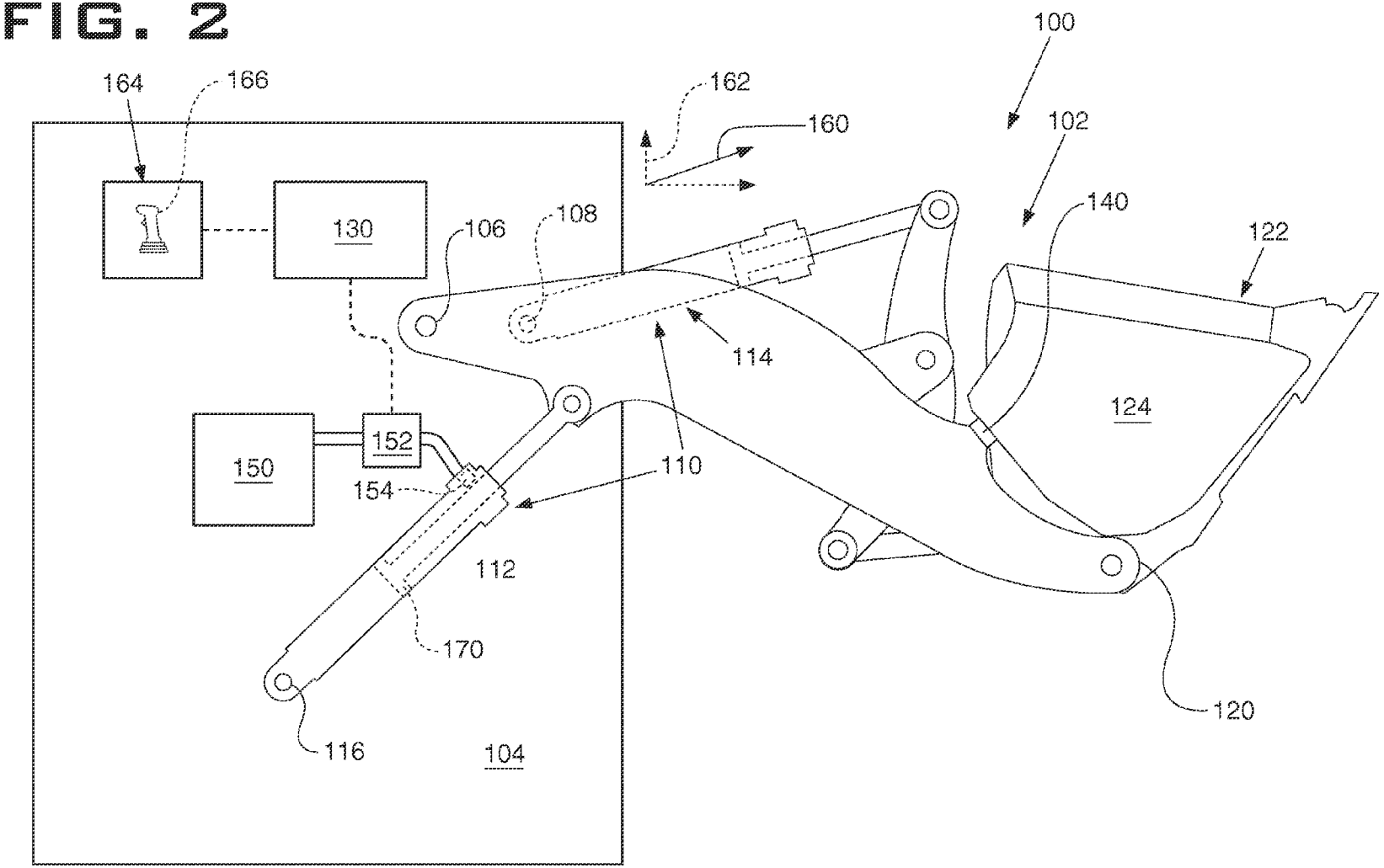
FIG. 2 is a plan view of the hydraulically actuated linkage of the machine of FIG. 1 in a second position.

Referring to FIG. 2, a plan view illustrates the hydraulically actuated linkage 102 of the machine 100 of FIG. 1 in a second position. Additionally, the first hydraulic actuator 112 may be hydraulically coupled to a tank 150 via a valve 152. The tank 150 may be an accumulator or a reservoir tank for hydraulic fluid.

Multiple factors may contribute to unintentional movement in the linkage 102. These factors may include air or voids 154 disposed within the rod portion 148 of the first hydraulic actuator 112 or opening the valve 152. However, there may be several reasons for opening the valve 152.

For example, when the valve 152 is opened, the pressure within the rod portion 148 of the first hydraulic actuator 112 may be lowered so that the first hydraulic actuator 112 may act as a damper. Consequently, an operator's ride in the machine 100 may be smoother, especially when the bucket 124 is filled with material (not shown). As the valve 152 is controlled by the ECM 130 to provide a smoother ride, this functionality may be known as "ride control."

Alternatively, the ECM 130 may open the valve 152 to provide a "float" functionality where the work tool 122 is allowed to move with the surface of the work area, which may be useful when the work tool 122 is being used to smooth or grade the work area.

Additionally, the valve 152 may be opened when a "lower kickout" function is engaged by the ECM 130. The "lower kickout" function permits an operator command to be given that directs the ECM 130 to return the linkage to a predetermined position by lowering fluid pressure within the rod portion 148 of the first hydraulic actuator 112.

As shown, the second hydraulic actuator 114 in this second position has moved the coupler 120 as far as it may pivot because of contact between the work tool 122 and the rack stop 140. However, the second hydraulic actuator 114 may still apply a force 160 to the linkage 102, a portion of which has a vertical force component 162. Generally, the vertical force component 162 may be countered by the first hydraulic actuator 112.

However, when voids 154 exist and/or the valve 152 is opened, the vertical force component 162 may not be countered by the first hydraulic actuator 112. Consequently, linkage 102 may be lifted and pivoted about pivot 106, which is an unintentional movement, because a lift command has not been issued via the operator interface 164 (FIG. 2). Additionally, fluid may be moved from the rod portion 148 to the tank 150 and the fluid within the head portion 144 uncompressed, which may cause the linkage 102 to unintentionally fall when the vertical force component 162 is removed.

Additionally, when the fluid within the head portion 144 is uncompressed, energy may be stored. The fluid and/or voids 154 within the rod portion 148 may also be compressed by the vertical force component 162 and store energy. This stored energy may cause the linkage 102 to be pulled down from the raised position when the vertical force component 162 is less than the stored energy.

In other words, when a tilt motion is commanded by an operator via an operator interface 164, a lift motion may be unintentionally caused. Of course, in other configurations of the linkage 102 and the plurality of hydraulic actuators 110, other motions may be unintentionally caused when one of a plurality of hydraulic actuators 110 are actuated.

The operator interface 164 as shown may include a joystick 166, but may also include keyboards, touch screens, buttons, levers, or any other input device known in the art. The operator interface 164 may be used to issue actuation commands directing the one or more of the plurality of hydraulic actuators 110 to move the linkage 102. The actuation commands may include, but are not limited to, a lift command and a tilt command. In the configuration shown in FIGS. 1 and 2, the lift command causes actuation of the first hydraulic actuator 112 while a tilt command causes actuation of the second hydraulic actuator 114.

To minimize this unintentional motion, the ECM 130 may determine that the valve 152 should be closed and/or the second hydraulic actuator 114 limited in movement to prevent this unintentional movement when a one or more factors are present. Additionally, the ECM 130 may limit the range of motion available to the coupler 120, and hence, the work tool 122. For example, actuated motion of the second hydraulic actuator 114 may be limited when the coupler is moved near the rack stop 140. Alternatively, the raising motion of the linkage 102 may be detected and compared to operator command signals to determine whether the raising motion is intentional. If the raising motion is determined to be unintentional, the ECM 130 may close the valve 152 and/or limit actuation of the second hydraulic actuator 114. In some configurations, an operator's tilt command may be limited so that the bucket 124 will not contact the rack stop 140.

In some configurations, if one or more sensors 132 is determined to be damaged, then the valve 152 may automatically be closed when tilting the coupler 120 near the rack stop 140.

INDUSTRIAL APPLICABILITY

A wide variety of inputs may be considered in determining when to limit motion of the second hydraulic actuator 114 or close the valve 152. For example, the ECM 130 may utilize a lift command and/or tilt command from the operator interface 164. Additionally, the ECM may also determine whether specific functionality has been engaged such as "ride control," "Lower kickout," or "float." The ECM 130 may also utilize data regarding the machine travel speed and/or travel direction.

The ECM 130 may also utilize status data from sensors associated with the plurality of hydraulic actuators 110 and the valve 152. Specifically, the ECM 130 may utilize data from the first hydraulic actuator 112 regarding the distance of its piston 170 to the minimum position and first hydraulic actuator 112 diagnostics. Similarly, the ECM 130 may utilize a sensor 172 or sensor 133 mounted to the linkage 102 to determine the tilt angle and the angular velocity of the coupler 120. The ECM 130 may also obtain diagnostic information on the sensor 172 to verify that it is still operating normally.

Figure 3:
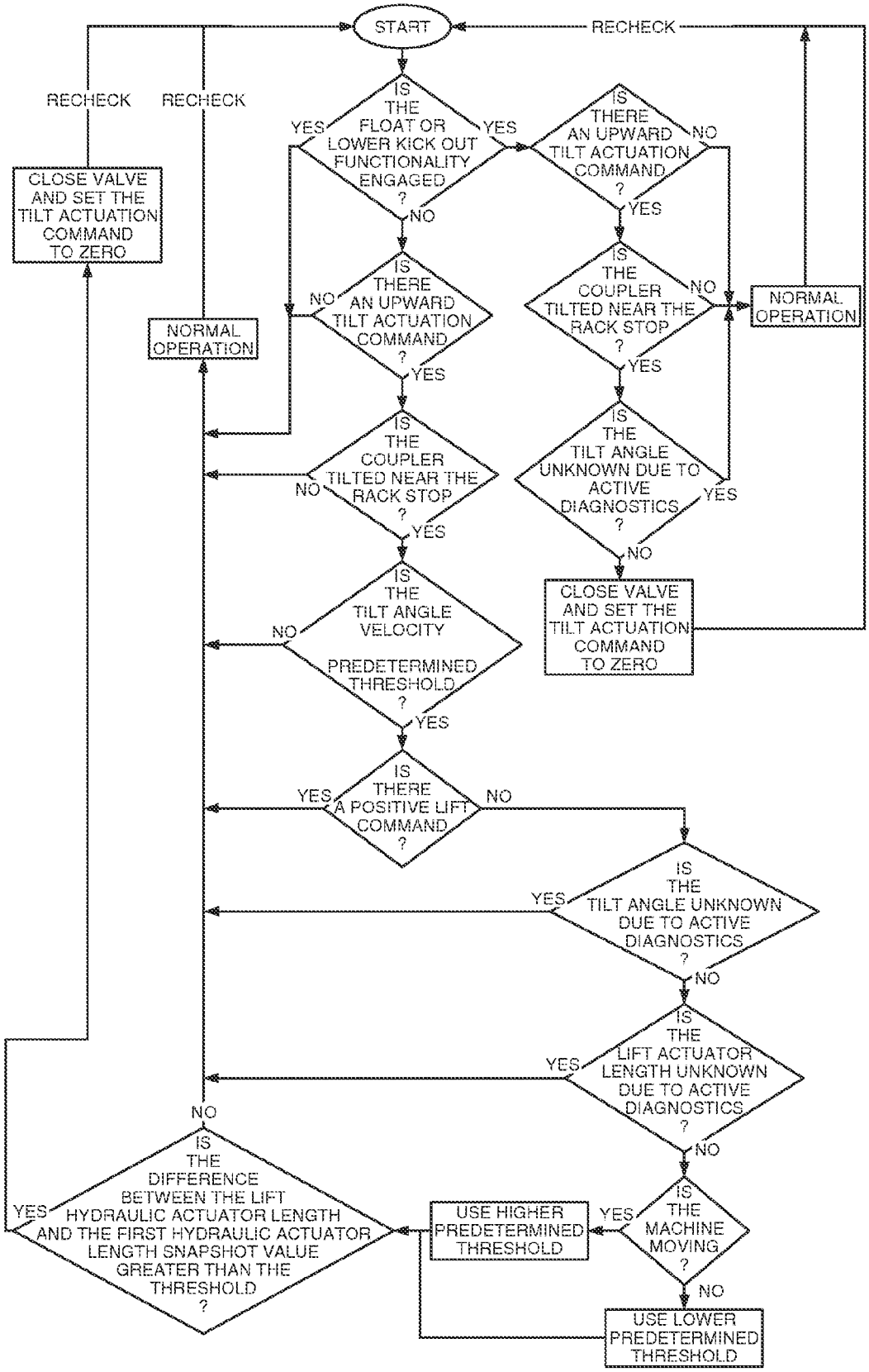
FIG. 3 is a block diagram of a method for controlling the motion of the hydraulically actuated linkage of the machine of FIG. 1.

In one embodiment of the invention and referring to FIG. 3, the ECM 130 may obtain and use a wide variety of inputs to determine when to actively prevent unintentional movement in the linkage 102. For example, the ECM 130 may monitor the movement of the first hydraulic actuator 112 compared with a first hydraulic actuator length snapshot value. The first hydraulic actuator length snapshot value is a position value taken after system start-up and when an operator is commanding tilt but not lift. Hence, the first hydraulic actuator length snapshot value is a reference point for determining unintentional movement of the linkage.

A logical test may be used to determine if a tilt command should be canceled, in some configurations the cancellation of the tilt command may be assigning the tilt command a zero value, to prevent the coupling 120 or the bucket 124 from abutting the rack stop 140, which permits the second hydraulic actuator to apply a vertical force component 162 on the linkage 102. One configuration of the test may be that if the difference between the sensed movement and the snapshot value is greater than a given threshold and there is no raise command, the bucket 124 is within a specified angle of the rack stop 140 (which is the maximum angle position), an upward tilt command is present, but the tilt angular velocity is equal to or below a given threshold (for example, not moving), then the tilt command would be canceled to prevent the bucket 124 from stalling against the rack stop 140.

Additionally, when the tilt command is zeroed, the valve 152 may be closed. The valve 152 may have been open, as part of the "ride control" functionality so that the ECM 130 may also permanently or temporarily cancel the "ride control" functionality to prevent the valve from being reopened until after the risk of unintentional movement has passed.

The sensitivity of this test may also be adjusted where the machine 100 has a ground speed that is less than a given threshold (which may indicate that the machine 100 is not moving). For example, the threshold to compare first hydraulic actuator length for detecting motion may be different than if the machine is moving above a specified ground speed. There may be some hysteresis in the ground speed measurement to determine whether the machine may be moving to prevent bouncing from one first hydraulic actuator length threshold to the other.

Also, if the valve 152 is in Float mode or the Lower Kickout functionality is active, then the tilt command may be limited when the coupler 120 is near the rack stop 140 to prevent the bucket 124 from contacting the rack stop 140, which may lead to stalling the second hydraulic actuator and potentially raising the linkage. To determine when the coupler 120 is near the rack stop 140, the ECM 130 may monitor the tilt angle of sensor 172 relative to the maximum position where the bucket 124 is abutting the rack stop 140. If the tilt angle to maximum position is less than a predetermined threshold angle, and if the tilt command is calling for tilting the coupler 120 upward, then the tilt command will be set to zero. In this configuration, the ride control functionality may optionally be placed in an OFF state.

Figure 4:
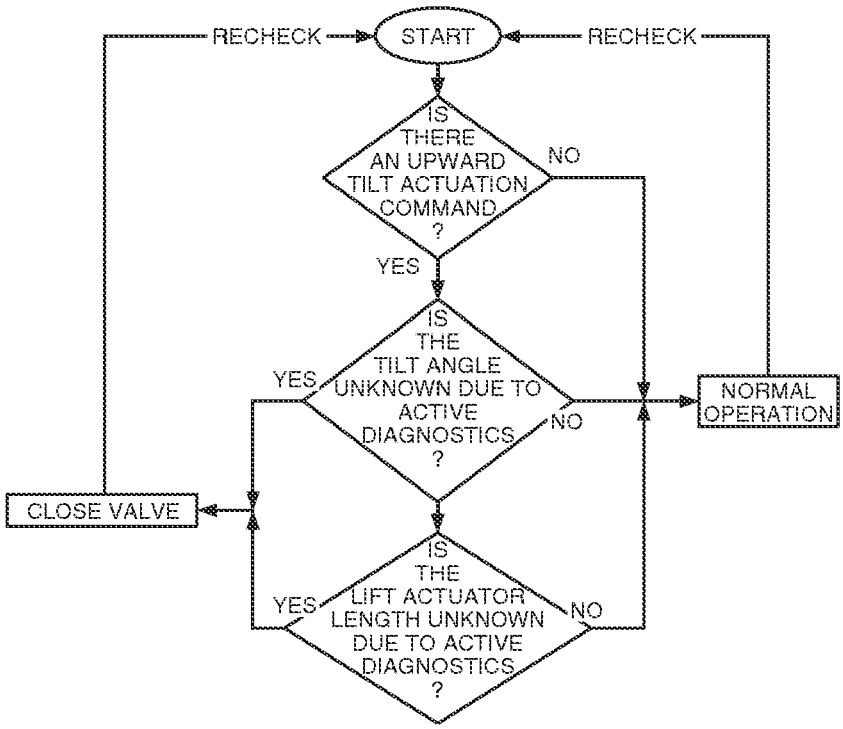
FIG. 4 is a block diagram of a method for controlling the motion of the hydraulically actuated linkage of the machine of FIG. 1.
Figure 5:
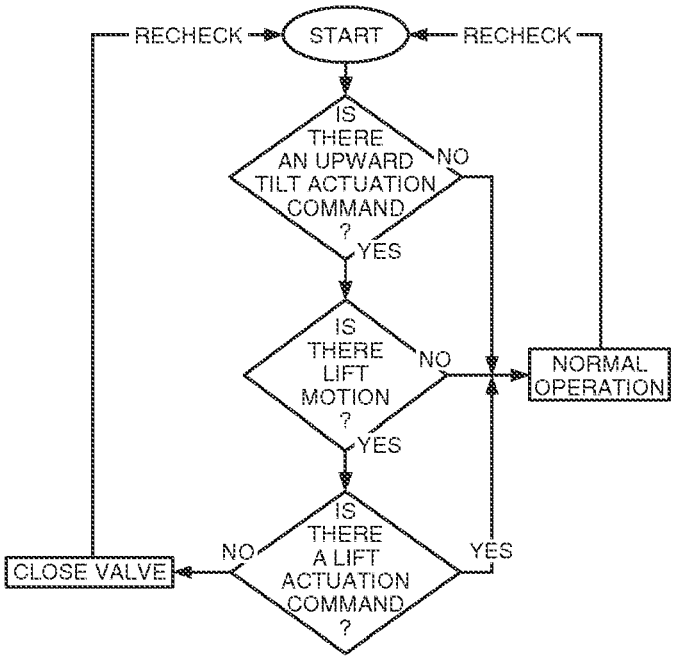
FIG. 5 is a block diagram of a method for controlling the motion of the hydraulically actuated linkage of the machine of FIG. 1.

In the event of a failure in the system and referring to FIG. 4, if either the tilt angle or the first hydraulic actuator length is not available, then ride control functionality may be placed in an OFF state when the ECM 130 receives a tilt command directing the second hydraulic actuator 114 to tilt the coupler 120 upward. If ground speed is unavailable or faulted, then the threshold for detecting first hydraulic actuator movement may use the "not moving" threshold.

The first hydraulic actuator movement thresholds should be set so that minimal movement is observed at the bucket, but not set too small that signal noise or other movement of the linkage won't cause the bucket to stop at unexpected times. For example, the first hydraulic actuator movement thresholds may be set to about 10 mm and about 20 mm for the movement threshold.

In some conditions, the ECM 130 may monitor rotary sensors 133, 174 to detect motion in the linkage 102. If either sensor 133, 174 stops working, then there may be a default mode of operation, which may close valve 152 whenever an operator issues an actuation command to the second hydraulic actuator 114 to tilt the bucket 124 upward toward the rack stop 140.

Alternatively, in configurations where the machine 100 has only one sensor 132 to monitor lift motion, the ECM 130 may prevent actuation of the second hydraulic actuator 114, when the operator interface 164 is providing a tilt actuation command and there is lift motion, but no lift actuation command.

What is claimed is:

1. A machine comprising:

a frame;

a linkage pivotally connected to the frame;

a first hydraulic actuator connected to the linkage and disposed to actuate the linkage through a first range of motion;

a second hydraulic actuator connected to the linkage and disposed to actuate the linkage through a second range of motion;

a sensor disposed to determine motion of at least one of the linkage, the first hydraulic actuator, and the second hydraulic actuator; and an electronic control module in communication with the sensor, the electronic control module configured to cancel an actuation command to one of the first hydraulic actuator and the second hydraulic actuator in response to the electronic control module determining, based upon the sensor, that unintentional motion of another of the first hydraulic actuator and the second hydraulic actuator has occurred due to the actuation command to the one of the first hydraulic actuator and the second hydraulic actuator.

2. The machine of claim 1, wherein the first hydraulic actuator is a lift actuator and the second hydraulic actuator is a tilt actuator.

3. The machine of claim 2, wherein the electronic control module is configured to cancel the actuation command in response to determining unintentional motion of the linkage wherein the actuation command is to the tilt actuator.

4. The machine of claim 1, wherein the sensor is a rotary sensor for detecting rotation of the linkage about the pivotal connection to the frame.

5. The machine of claim 1, wherein the electronic control module determination of unintentional motion of the another of the first hydraulic actuator and the second hydraulic actuator includes detecting an absence of an actuation command for the another of the first hydraulic actuator and the second hydraulic actuator.

6. The machine of claim 1, wherein upon the electronic control module determining that at least one of ride control functionality, lower kickout functionality, and float functionality is engaged, and upon the electronic control module detecting unintentional motion of the another of the first hydraulic actuator and the second hydraulic actuator, the electronic control module disengages the at least one of ride control functionality, lower kickout functionality, and float functionality.

7. The machine of claim 1, wherein at least one of the first hydraulic actuator and the second hydraulic actuator includes a valve, and upon the electronic control module detecting unintentional motion of the another of the first hydraulic actuator and the second hydraulic actuator, the electronic control module closes the valve of the at least one of the first and second hydraulic cylinders.

8. The machine of claim 7, wherein the electronic control module is configured to close the valve if failure of the sensor is determined.

9. The machine of claim 1, wherein the sensor is disposed to detect unintentional motion of the first hydraulic actuator by detecting changes in a first hydraulic actuator length, wherein the electronic control module determines a first hydraulic actuator length snapshot value, wherein upon an actuation command being sent to the second hydraulic actuator, the electronic control module compares the first hydraulic actuator length snapshot value with the first hydraulic actuator length to determine unintentional motion of the first hydraulic actuator.

10. The machine of claim 9, wherein the electronic control module determination of unintentional motion of the linkage includes comparing the detected unintentional motion against a movement threshold.

11. The machine of claim 10, wherein the electronic control module determines a machine travel speed, wherein the electronic control module determines the movement threshold based on the machine travel speed.

12. The machine of claim 10, wherein the movement threshold is between about 10 mm and about 20 mm.

13. A machine comprising:

a frame;

a linkage pivotally connected to the frame, the linkage including a rack stop and one or more of a coupler and a work tool;

a lift hydraulic actuator connected to the linkage and disposed to actuate the linkage relative to the frame;

a tilt hydraulic actuator connected to the linkage and disposed to actuate the one or more of the coupler and the work tool relative to the rack stop;

a sensor; and an electronic control module in communication with the sensor, the electronic control module configured to determine, based upon input from the sensor, that one of the coupler and the work tool is disposed in proximity to the rack stop, wherein the electronic control module is configured to cancel an actuation command to one of the lift hydraulic actuator and the tilt hydraulic actuator in response to determining that one of the coupler and the work tool is disposed in proximity to the rack stop and unintentional movement of one of the lift hydraulic actuator and the tilt hydraulic actuator is occurring.

14. The machine of claim 13, wherein the sensor is a rotary sensor for detecting rotation of the linkage about the pivotal connection to the frame.

15. The machine of claim 14, wherein the electronic control module determines a tilt angle velocity of the coupler or the work tool relative to the rack stop, wherein the electronic control module compares the tilt angle velocity with a threshold to determine whether the coupler or the work tool is disposed near or in contact with the rack stop.

16. The machine of claim 13, wherein the electronic control module further determines whether a lift command has a zero value, wherein the electronic control module only cancels the actuation command to one of the lift hydraulic actuator and the tilt hydraulic actuator if the lift command has the zero value and one of the coupler and the work tool is disposed in proximity to the rack stop.

17. A machine comprising:

a frame;

a linkage pivotally connected to the frame;

a lift hydraulic actuator connected to the linkage, the lift hydraulic actuator including a valve;

a tilt hydraulic actuator connected to the linkage;

a sensor; and an electronic control module in communication with the sensor, the electronic control module configured to close the valve in response to the electronic control module determining, based upon the sensor, that unintentional motion of the lift hydraulic actuator has occurred due to actuation of the tilt hydraulic actuator.

18. The machine of claim 17, wherein determining unintentional motion of the lift hydraulic actuator includes determining, based upon the sensor, that an upward tilt actuation command has been issued.

19. The machine of claim 18, further comprising a second sensor, wherein the second sensor is disposed to detect changes in length of the lift hydraulic actuator, wherein the electronic control module obtains a first hydraulic actuator length snapshot value, wherein determining unintentional motion of the linkage includes comparing the first hydraulic actuator length snapshot value with the length of lift hydraulic actuator to determine unintentional motion of the linkage.

20. The machine of claim 19, wherein determining unintentional motion of the linkage includes determining that a lift actuation command has a zero value.

* * * * *